US009121624B2

(12) United States Patent
Matsui et al.

(10) Patent No.: US 9,121,624 B2
(45) Date of Patent: Sep. 1, 2015

(54) INFORMATION TRANSFER SYSTEM FOR REFRIGERATION AIR-CONDITIONING APPARATUS

(75) Inventors: Kenji Matsui, Tokyo (JP); Shigeo Takata, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 669 days.

(21) Appl. No.: 13/254,390

(22) PCT Filed: Mar. 26, 2009

(86) PCT No.: PCT/JP2009/056117

§ 371 (c)(1),
(2), (4) Date: Sep. 1, 2011

(87) PCT Pub. No.: WO2010/109627

PCT Pub. Date: Sep. 30, 2010

(65) Prior Publication Data

US 2011/0308263 A1 Dec. 22, 2011

(51) Int. Cl.
*F24F 11/00* (2006.01)
*F24F 3/06* (2006.01)

(52) U.S. Cl.
CPC ..... *F24F 11/006* (2013.01); *F24F 3/065* (2013.01); *F24F 2011/0067* (2013.01); *F24F 2011/0068* (2013.01)

(58) Field of Classification Search
CPC . F24F 11/006; F24F 3/065; F24F 2011/0068; F24F 2011/0067
USPC ..... 62/185, 201, 199, 509, 132
See application file for complete search history.

(56) References Cited

U.S. PATENT DOCUMENTS 4,926,652 A * 5/1990 Kitamoto ..... 62/175
5,347,826 A * 9/1994 Hayashida et al. ..... 62/197

(Continued)

FOREIGN PATENT DOCUMENTS

EP 1548377 A2 * 6/2005
EP 1 780 476 A1 5/2007

(Continued)

OTHER PUBLICATIONS

Office Action (Notice of Reasons for Rejection) dated Oct. 23, 2012, issued by the Japanese Patent Office in the corresponding Japanese Patent Application No. 2011-505750 and an English translation thereof. (4 pages).

(Continued)

*Primary Examiner* — Allana Lewin Bidder
*Assistant Examiner* — Kun Kai Ma
(74) *Attorney, Agent, or Firm* — Buchanan Ingersoll & Rooney PC

(57) ABSTRACT

An information transfer system for a refrigeration air-conditioning apparatus in which one or more heat-source units for the refrigerating/air conditioning apparatus, one first relay unit, and one or more second relay units are connected by refrigerant piping, and the second relay units and one or more indoor units are connected by water piping, wherein communications are performed discretely between a pair of the heat-source unit and the first relay unit, a pair of the first relay unit and the second relay units, and a pair of the second relay units and the indoor units through transmission lines respectively.

5 Claims, 9 Drawing Sheets

(56) References Cited

U.S. PATENT DOCUMENTS

| | | | | |
|---|---|---|---|---|
| 6,311,506 | B1 * | 11/2001 | Takahashi et al. | 62/196.4 |
| 2006/0123813 | A1 * | 6/2006 | Ha et al. | 62/179 |
| 2007/0028631 | A1 * | 2/2007 | Fukuda et al. | 62/185 |
| 2009/0139251 | A1 * | 6/2009 | Masui | 62/129 |

FOREIGN PATENT DOCUMENTS

| | | | | |
|---|---|---|---|---|
| JP | 5-280818 | A | | 10/1993 |
| JP | 7-127894 | A | | 5/1995 |
| JP | 11-344240 | A | | 12/1999 |
| JP | 2003-322388 | A | | 11/2003 |
| JP | 2007147274 | A | * | 6/2007 |
| JP | 2009-052769 | A | | 3/2009 |
| WO | WO 2008035402 | A1 | * | 3/2008 |
| WO | 2008051960 | A2 | | 5/2008 |

OTHER PUBLICATIONS

Extended European Search Report dated Nov. 26, 2012, issued by the European Patent Office in the corresponding European Application No. 09842241.3. (6 pages).

Office Action (Text Portion of the Notification of the First Office Action) dated Jun. 28, 2013, issued by the Japanese Patent Office in the corresponding Japanese Patent Application No. 200980158369.2 and an English translation thereof. (9 pages).

International Search Report (PCT/ISA/210) issued on Jun. 2, 2009, by Japanese Patent Office as the International Searching Authority for International Application No. PCT/JP2009/056117.

* cited by examiner

INFORMATION TRANSFER SYSTEM FOR REFRIGERATION AIR-CONDITIONING APPARATUS

TECHNICAL FIELD

The present invention relates to a refrigeration air-conditioning apparatus and, more particularly, relates to improvement in stability of the driving of a refrigeration air-conditioning apparatus including both a refrigerant circuit and a water circuit.

BACKGROUND ART

Hitherto, there have been cooling apparatuses and air-conditioning apparatuses (hereinafter referred to as refrigeration air-conditioning apparatuses) including a water circuit and a refrigerant circuit (see, for example, Patent Literature 1). In such an apparatus, a circuit that inputs a pump driving signal of a water circuit to a heat-source unit having a compressor and that does not operate the compressor when there is no input, so-called interlock circuit, has been often configured by hardware.

PATENT LITERATURE

[Patent Literature 1] Japanese Unexamined Patent Application Publication No. 7-127894

DISCLOSURE OF INVENTION

Problems to be Solved by the Invention

However, in a refrigeration air-conditioning apparatus in which a heat-source unit, a first relay unit, a second relay unit, and an indoor unit are connected by transmission lines, since the heat-source unit, the first relay unit, the second relay unit, and the indoor unit in series are connected by the transmission lines at multiple stages, the interlock equipped by hardware has a problem to be very complex, including a matter of distance.

Furthermore, a system having both a refrigerant circuit and a water circuit has concerns that the system will become large; the communication protocol will become complicated; and address allocation and communication traffic become problematic, if a communication medium is used in common.

The present invention has been achieved to solve the above-described problems in an information transfer system for a refrigeration air-conditioning apparatus in which a heat-source unit, a first relay unit, and a second relay unit are connected by refrigerant piping, and a second relay unit and an indoor unit are connected by water piping.

A main object of the present invention is to obtain an information transfer system for a refrigeration air-conditioning apparatus in which stability of information transfer is ensured by communicating through respective transmission lines discretely between a pair of a heat-source unit and a first relay unit, a pair of the first relay unit and a second relay unit, and a pair of the second relay unit and an indoor unit.

Another object of the present invention is to obtain an information transfer system for a refrigeration air-conditioning apparatus that does not require a interlock circuit with complex hardware and enables to suppress the stress of refrigerant/water circuits by communicating only between the set of the heat-source unit and the first relay unit, the set of the first relay unit and the second relay unit, and the set of the second relay unit and the indoor unit, and by defining an operation sequence among units at start/stop time through the communication.

A further object of the present invention is to enable the communication to be performed using different media/means among the set of the heat-source unit and the first relay unit, the set of the first relay unit and the second relay unit, and the set of the second relay unit and the indoor unit, resulting in increasing the degree of freedom in structuring a product. Still another object of the present invention is to obtain an information transfer system for a refrigeration air-conditioning apparatus that realizes an improvement of quality and a reduction in cost, improves the degree of freedom of address allocation and reduces communication traffic by using optimal communication medium/means for each communication.

Means for Solving the Problems

An information transfer system for a refrigeration air-conditioning apparatus according to the present invention is an information transfer system for a refrigeration air-conditioning apparatus in which at least one heat-source unit of the refrigeration air-conditioning apparatus, one first relay unit, and at least one second relay unit are connected by refrigerant piping, and the second relay unit and at least one indoor unit are connected to each other by water piping, wherein communications are performed discretely between a pair of the heat-source unit and the first relay unit, a pair of the first relay unit and the second relay unit, and a pair of the second relay unit and the indoor unit, through transmission lines respectively.

Advantages

The present invention has advantageous effects such that communication of information is performed only between the heat-source unit and the first relay unit, between the first relay unit and the second relay unit, and between the second relay unit and the indoor unit, thereby simplifying the procedure of information transfer and ensuring the stability of operations. Furthermore, a complex interlock circuit in the form of hardware is not needed, and stress in the refrigerant circuit and the water circuit can be suppressed.

By using different media/means for communication between a pair of units, it is possible to increase the degree of freedom of product configuration. In addition, as a result of using an optimal medium/means for each pair, the present invention has advantageous effects such that improvement in quality and reduction in cost can be realized, the degree of freedom of address allocation is improved, and communication traffic can be reduced.

REFERENCE NUMERALS

1 heat-source unit (heat-source-side unit or outdoor unit), 2*a* to 2*d* indoor unit (use-side unit), 3*a* first relay unit, 3*b* second relay unit, 3*c* second relay unit, 4*a* refrigerant piping, 4*b* refrigerant piping, 4*c* refrigerant piping, 5*a* water piping, 5*b* water piping, 5*c* water piping, 5*d* water piping, 7 transmission line, 8 transmission line, 9*a* transmission line, 9*b* transmission line, 9*c* transmission line, 9*d* transmission line, 10 transmission line, 11 heat-source unit controller, 21*a* to 21*d* indoor unit controller, 22*a* to 22*d* remote controller, 31*a* first relay controller, 31*b* second relay controller, 31*c* second relay controller

BEST MODES FOR CARRYING OUT THE INVENTION

Embodiment 1

Figure 1:
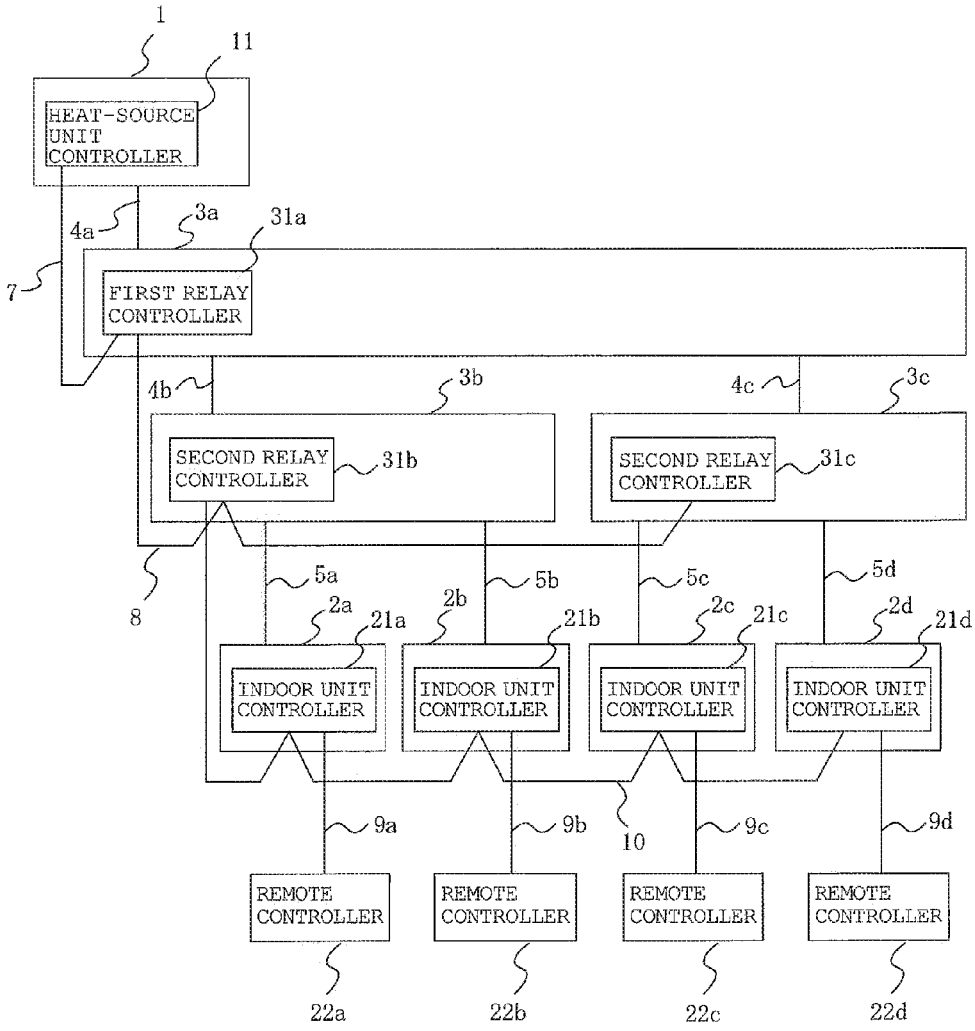
FIG. 1 is a schematic diagram illustrating an information transfer system for a refrigeration air-conditioning apparatus in Embodiment 1.

FIG. 1 is a schematic diagram illustrating an information transfer system for a refrigeration air-conditioning apparatus in Embodiment 1 of the present invention. As shown in FIG. 1, a heat-source unit (heat-source-side unit or outdoor unit) 1, a first relay unit 3*a*, second relay units 3*b* and 3*c* are connected by refrigerant piping 4*a* to 4*c*, forming one refrigerant circuit system.

Furthermore, the second relay unit 3*b* and a plurality of indoor units (use-side units) 2*a* and 2*b* are connected by water piping 5*a* and 5*b*, forming one water circuit system, and the second relay unit 3*c* and a plurality of indoor units (use-side units) 2*c* and 2*d* are connected by water piping 5*c* and 5*d*, forming one water circuit system.

The heat-source unit 1 includes a compressor, a valve circuit such as a four-way valve, an outdoor-side heat exchanger and the like, and supplies heat necessary for the system over a refrigerant.

The first relay unit 3*a* includes a gas liquid separator, a valve circuit and the like, divides the transported refrigerant into three: high-pressure gas, middle-pressure liquid, and low pressure gas, and supplies them to cooling and heating heat sources.

The second relay units 3*b* and 3*c* each include a refrigerant-water heat exchanger, a directional control valve, a water pump, and the like, transfer necessary heat to water from the cooling refrigerant and the heating refrigerant, and circulate the water having necessary quantity of heat into the water circuit.

The indoor units 2*a* to 2*d* each include an indoor-side heat exchanger, and perform heat exchange transfer of the quantity of heat from the water circulating into the water circuit to the indoor air.

The heat-source unit 1 is controlled by the heat-source unit controller 11, and the first relay unit 3*a* is controlled by the first relay controller 31*a*. Furthermore, the second relay units 3*b* and 3*c* are controlled by the second relay controllers 31*b* and 31*c*, respectively, and the indoor units 2*a* to 2*d* are controlled by the indoor unit controllers 21*a* to 21*d*, respectively.

The heat-source unit controller 11 and the first relay controller 31*a* are directly connected to enable to transfer information each other through a transmission line 7. The first relay controller 31*a* and the second relay controllers 31*b* and 31*c* are directly connected to enable to transfer information one another through a transmission line 8. The second relay controllers 31*b* and 31*c* and the indoor unit controllers 21*a* to 21*d* are directly connected to enable to transfer information one another through a transmission line 10. Furthermore, the indoor unit controllers 21*a* to 21*d* are directly connected to the remote controllers 22*a* to 22*d* to enable to transfer information each other through transmission lines 9*a* to 9*d* respectively. Also, the term "transmission line" described above includes both the concepts of wired and wireless.

It is assumed that the heat-source unit controllers 11, the first relay controller 31*a*, the second relay controllers 31*b* and 31*c*, the indoor unit controllers 21*a* to 21*d*, and the remote controllers 22*a* to 22*d* are each allocated with a unique address, and know the addresses of communication parties at the time of system start on the basis of a manual setting or an automatic discrimination process.

Figure 2:
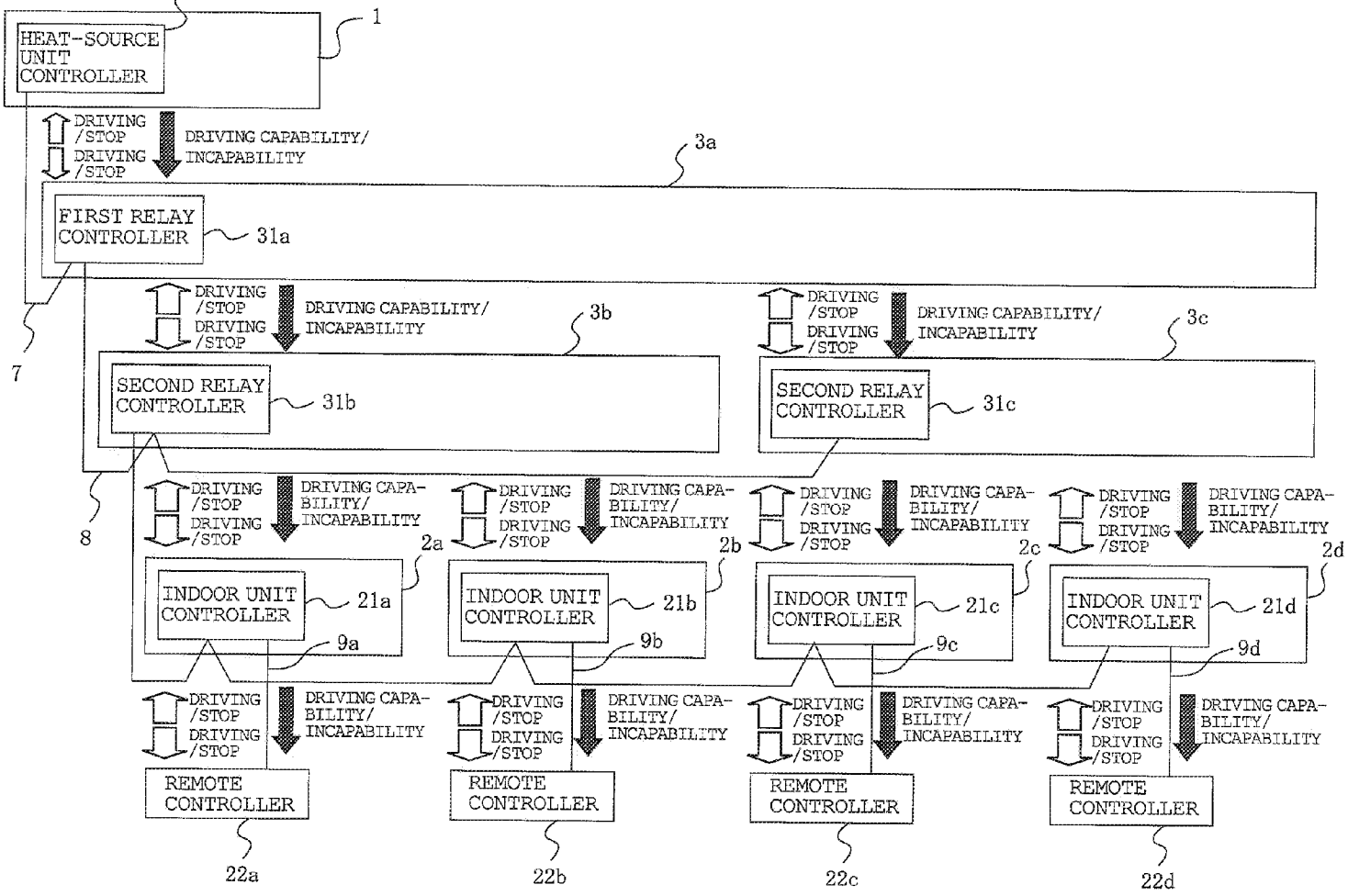
FIG. 2 illustrates communication processes between pairs of units in the refrigeration air-conditioning apparatus in Embodiment 1.
Figure 3A:
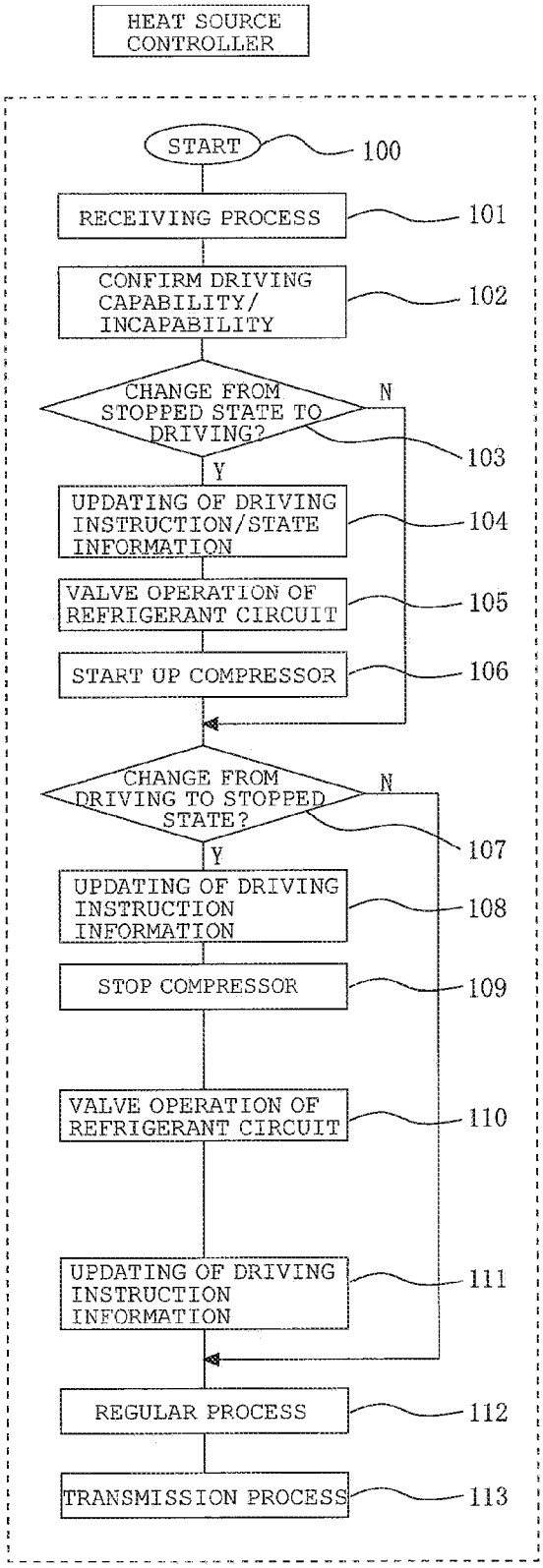
FIG. 3 is flowcharts illustrating processes of communications and operations of the refrigeration air-conditioning apparatus in Embodiment 1.
Figure 3B:
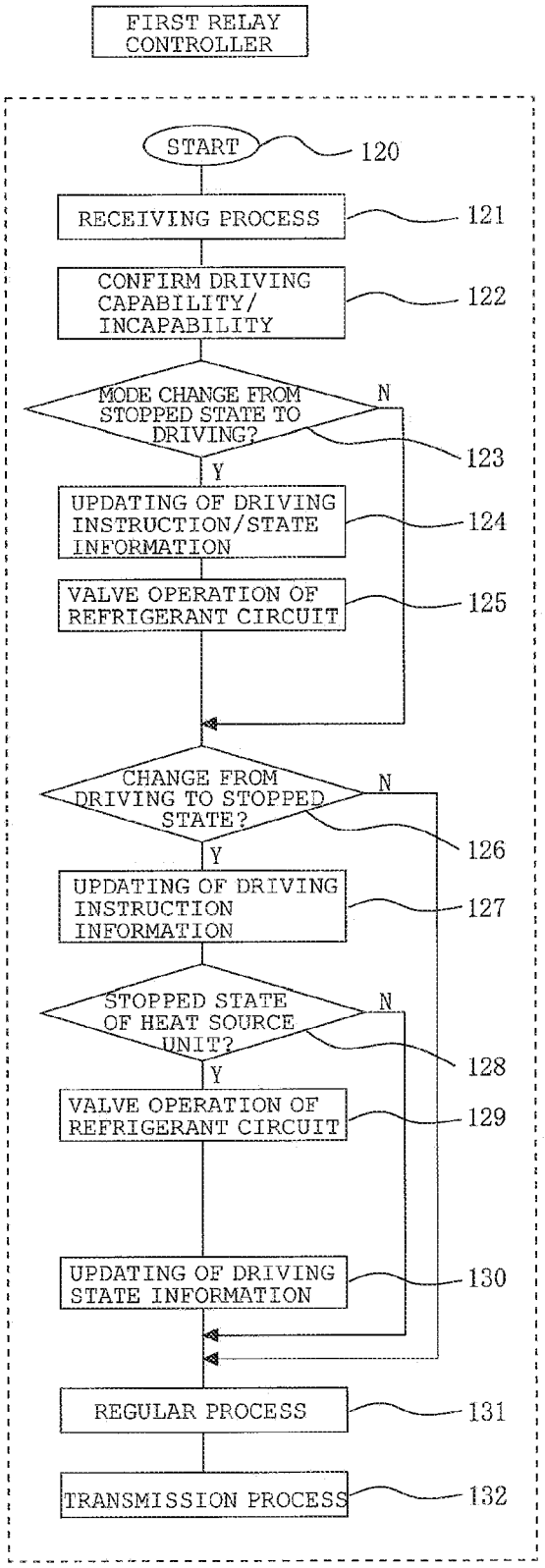
Figure 3C:
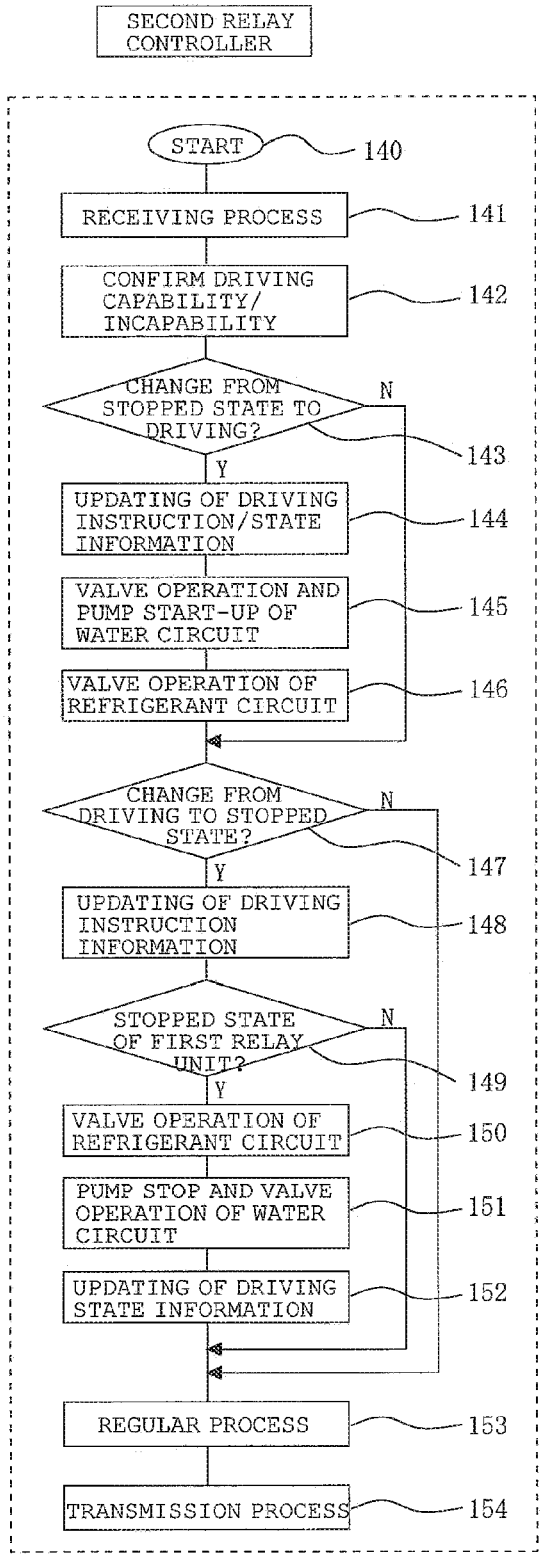
Figure 3D:
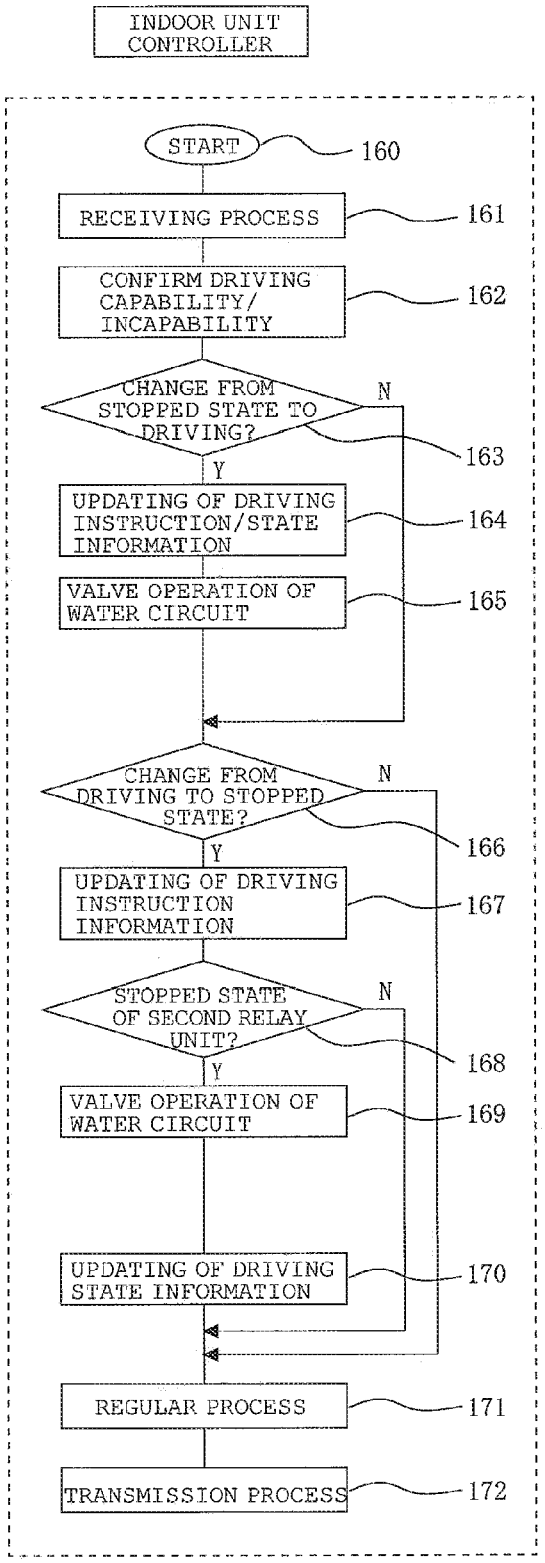

FIG. 2 illustrates the form of a communication process between pairs of units in the refrigeration air-conditioning apparatus of FIG. 1. The heat-source unit controller 11 performs communication only with the first relay controller 31*a*. The first relay controller 31*a* transmits driving/stopping instruction information of the first relay controller 31*a* to the heat-source unit controller 11, and the heat-source unit controller 11 transmits driving/stopped state information of the heat-source unit controller 11 to the first relay controller 31*a*. The driving/stopping instruction information may contain information on an operation mode, such as heating/cooling, and the like (the same also applies hereinafter). Furthermore, some communications are preformed with transmitting and receiving information periodically and some are preformed with transmitting and receiving at the time of a change.

Furthermore, the heat-source unit controller 11 transmits driving capability/incapability information of the heat-source unit controller 11 to the first relay controller 31*a*. The driving incapability information is set in a case where operation can not be performed due to a decrease in the main power supply of the heat-source unit, an abnormal input from temperature and pressure sensors, or the like.

The first relay controller 31*a* performs communication only with the heat-source unit controller 11 and the second relay controllers 31*b* and 31*c*. The second relay controllers 31*b* and 31*c* transmit driving/stopping instruction information of the second relay controllers 31*a* and 31*b* to the first relay controller 31*a*, and the first relay controller 31*a* transmits driving/stopped state information of the first relay controller 31*a* to the second relay controllers 31*b* and 31*c*. Furthermore, the first relay controller 31*a* transmits driving capability/incapability information of the first relay controller 31*a* to the second relay controllers 31*b* and 31*c*. The driving incapability information of the first relay controller 31*a* contains a case of a decrease in the main power supply of the first relay controller 31*a*, an abnormal input from temperature and pressure sensors, or the like, and the case in which the driving incapability information is received from the heat-source unit controller 11.

The second relay controller 31*b* performs communication only with the first relay controller 31*a* and the indoor unit controllers 21*a* and 21*b*. The indoor unit controllers 21*a* and 21*b* transmit driving/stopping instruction information of the indoor unit controllers 21*a* and 21*b* to the second relay controller 31*b*, and the second relay controller 31*b* transmits driving/stopped state information of the second relay controller 31*b* to the indoor unit controllers 21*a* and 21*b*.

Furthermore, the second relay controller 31*b* transmits driving capability/incapability information of the second relay controller 31*b* to the indoor unit controllers 21*a* and 21*b*. The driving incapability information of the second relay controller 31*b* contains a case of a decrease in the main power supply of the second relay controller 31*b*, an abnormal input from temperature and pressure sensors, and the like, and the case in which driving incapability information has been received from the first relay controller 31*a*.

Similarly, the second relay controller 31*c* performs communication only with the first relay controller 31*a* and the indoor unit controllers 21*c* and 21*d*.

The indoor unit controller 21*a* performs communication only with the second relay controller 31*b* and the remote controller 22*a*. The remote controller 22*a* transmits setting information such as driving/stopping of the remote controller 22*a* to the indoor unit controller 21*a*, and the indoor unit controller 21*a* transmits driving/stopping information of the indoor unit controller 21*a* to the remote controller 22*a*. Furthermore, the indoor unit controller 21*a* transmits driving capability/incapability information of the indoor unit controller 21*a* to the remote controller 22*a*. The indoor unit controllers 21*b*, 21*c*, and 21*d* also function in the same behavior.

FIG. 3 is flowcharts illustrating processes of communications and operations at the time of a change from stopped state to driving and at the time of a change from driving to stopped state out of operations of the heat-source unit controller 11, the first relay controller 31*a*, the second relay controllers 31*b* and 31*c*, and the indoor unit controllers 21*a* to 21*d*. In FIG. 3, step 100 to step 113 indicate the process of the heat-source unit controller 11, step 120 to step 132 indicate the process of the first relay controller 31*a*, step 140 to step 154 indicate the process of the second relay controllers 31*b* and 31*c*, and step 160 to step 172 indicate the process of the indoor unit controllers 21*a* to 21*d*.

(1) Communication when Compressor is Started

With reference to FIG. 3, the content of communication when the compressor of the refrigeration air-conditioning apparatus is started will be described. A description will be given of communication in a case where a remote controller 22*a* is operated in a state in which all the indoor units 2*a* to 2*d* are stopped, and the refrigeration air-conditioning apparatus starts to be driven. First, an operator operates the remote controller 22*a*, and performs setting of an operation mode, a setting temperature, a wind direction, a wind velocity, and the like. The remote controller 22*a* transmits the set information to the indoor unit controller 21*a* through a transmission line 9*a*.

The indoor unit controller 21*a* performs processes of step 160 to step 172. First, in step 161, communications are newly received, and a process for analyzing the received communications is performed. The communications that are received here are driving capability/incapability information from the second relay controller 31*b* through the transmission line 10 that is connected to the second relay controller 31*b*, the driving/stopped state information of the second relay controller 31*b*, and the driving/stopping instruction information from the remote controller 22*a* through the transmission line 9*a* that is connected to the remote controller 22*a*.

After the analysis process is performed, in step 162, the driving capability/incapability of the indoor unit 2*a* is determined on the basis of the driving capability/incapability information from the second relay controller 31*b*, the power-supply state and the temperature of the indoor unit 2*a* itself, the input value of the pressure sensor, and the like, and the process then returns to step 163. The driving capability/incapability information from the second relay controller 31*b* contains a case in which one of the second relay controller 31*b*, the first relay controller 31*a*, and the heat-source unit controller 11 cannot be driven.

In step 163, it is determined whether or not a change from stopped state to driving is performed, and when the change is to be performed, the process proceeds to step 164, and when not, the process proceeds to step 166. This case is a case in which a driving instruction has been received from the remote controller 22*a*, driving capability information has been received from the second relay controller 31*b*, and the indoor unit 2*a* itself is capable of driving, and thus, the process proceeds to step 164.

In step 164, updates of the driving instruction and the driving state information are performed, and the process then proceeds to step 165. Here, the driving instruction information and the driving state information of the indoor unit controller 21*a* is set as driving.

In step 165, a valve of the water circuit in the indoor unit 2*a* and the like are operated, and the process proceeds to step 166. It is determined in step 166 whether or not a change from driving to stopped state is performed, and when the change is to be performed, the process proceeds to step 167, and when not, the process proceeds to step 171. In this case, since the change is not performed, the process proceeds to step 171. In step 171, it is determined whether or not regular processes such as acquisition of sensor input and actuator control are performed, and the process proceeds to step 172. In step 172, a process for newly transmitting a communication is performed. Here, since the driving instruction information and the driving state information of the indoor unit 2*a* have changed from stopped state to driving, driving information is transmitted to the second relay controller 31*b* through the transmission line 10.

When the driving operation does not perform, the indoor unit controller 21*a* sends back incapability information to the remote controller 22*a*. When the remote controller 22*a* receives incapability information, the display expression is changed to show stopped state, an in-preparation state, an error state or the like. Furthermore, in the case of a driving incapability state, by not transmitting driving information that is set by the remote controller 22*a* to the second relay controller 31*b*, it is possible to suppress an increase in the communication traffic.

Next, the operation of the second relay controller 31*b* will be described. The second relay controller 31*b* performs the processing from step 140 to step 154. First, in step 141, a processing for analyzing newly received communication is performed. The communications that are received here are driving capability/incapability information from the first relay controller 31*a* through the transmission line 8 that is connected to the first relay controller 31*a*, driving/stopped state information for the first relay controller 31*a*, and driving/stopping instruction information from the indoor unit controllers 21*a* and 21*b* through the transmission line 10 that is connected to the indoor unit controller 21*a*.

After the analysis process is performed, in step 142, the driving capability/incapability of the second relay unit 3*b* is determined on the basis of the driving capability/incapability information from the first relay controller 31*a*, the power-supply state and the temperature of the second relay controller 31*b* itself, the input value of the pressure sensor, and the like, and the process then proceeds to step 143. The driving capability/incapability information from the first relay controller 31*a* includes a case in which one of the first relay controller 31*a* and the heat-source unit controller 11 cannot be driven.

In step 143, it is determined whether or not a change from stopped state to driving is performed, when the change is to be performed, the process proceeds to step 144, and when not, the process proceeds to step 147. In this case, a driving instruction has been received from the indoor unit controller 21*a*, the driving capability information has been received from the first relay controller 31*a*, and in order that the second relay unit 3*b* itself is made operable, the process proceeds to step 144. In step 144, updating of the driving instruction information and the driving state information is performed, and the process then proceeds to step 145. Here, the driving instruction information and the driving state information of the second relay controller 31*b* are set as driving.

In step 145, the valve of the water circuit and the like in the second relay unit 3*b* are operated, causing a pump to be started. After that, the process proceeds to step 146. In step 146, the valve of the refrigerant circuit and the like in the second relay unit 3*b* are operated, and the process then proceeds to step 147.

In step 147, it is determined whether or not a change from driving to stopped state is to be performed, when the change is to be performed, the process proceeds to step 148, and when not, the process proceeds to step 153. In this case, by assuming that the change is not to be performed, the process proceeds to step 153. In step 153, regular processes such as acquisition of sensor input and actuator control are performed, and the process then proceeds to step 154. In step 154, a process for newly transmitting a communication is performed. Here, since the driving instruction information and the driving state information of the second relay unit 3*b* have changed from stopped state to driving, the driving information is transmitted to the first relay controller 31*a* through the transmission line 8.

Next, a description will be given of the operation of the first relay controller 31*a*. The first relay controller 31*a* performs the processes from step 120 to step 132. First, in step 121, a process for analyzing the newly received communications is performed. The communications that are received here are driving capability/incapability information from the heat-source unit controller 11 through the transmission line 7, which is connected to the heat-source unit controller 11, driving/stopped state information for the heat-source unit controller 11, and driving/stopping instruction information from the second relay controller 31*b* through the transmission line 8, which is connected to the second relay controller 31*b*.

After the analysis process is performed, in step 122, the driving capability/incapability of the first relay unit 3*a* is determined on the basis of the driving capability/incapability information from the heat-source unit controller 11 and the power-supply state, the inputs of temperature and pressure sensors of the first relay controller 31*a* itself and the like, and the process proceeds to step 123.

In step 123, it is determined whether or not a change from stopped state to driving is performed, when the change is to be performed, the process proceeds to step 124, and when not, the process proceeds to step 126. In this case, the driving instruction has been received from the second relay controller 31*b*, the driving capability information has been received from the heat-source unit controller 11, and in order that the first relay unit 3*a* itself is made operable, the process proceeds to step 124. In step 124, updating of the driving instruction information and the driving state information is performed, and the process then proceeds to step 125. Here, the driving instruction information and the driving state information of the first relay controller 31*a* are set as driving.

In step 125, the valve of the refrigerant circuit and the like in the first relay unit 3*a* are operated, and the process then proceeds to step 126. In step 126, it is determined whether or not a change from driving to stopped state is to be performed, when the change is to be performed, the process proceeds to step 127, and when not, the process proceeds to step 131. In this case, since the change is not performed, the process proceeds to step 131. In step 131, regular processes such as acquisition of sensor input and actuator control are performed, and the process then proceeds to step 132. In step 132, a process for newly transmitting a communication is performed. Here, since the driving instruction information and the driving state information of the first relay unit 3*a* have been changed from stopped state to driving, the driving information is transmitted to the heat-source unit controller 11 through the transmission line 7.

Next, a description will be given of the operation of the heat-source unit controller 11. The heat-source unit controller 11 performs the processes of step 100 to step 113. First, in step 101, a process for analyzing the newly received communication is performed. The communication that is received here is driving/stopping instruction information from the second relay controller 31*b* through the transmission line 7, which is connected to the first relay controller 31*a*.

After the analysis process is performed, in step 102, the driving capability/incapability of the heat-source unit 1 is determined on the basis of the power-supply state, the temperature and the pressure sensor input value of the heat-source unit controller 11 itself, and the like, and the process then proceeds to step 103.

In step 103, it is determined whether or not a change from stopped state to driving is to be performed, when the change is to be performed, the process proceeds to step 104, and when not, the process proceeds to step 107. In this case, the driving instruction has been received from the first relay controller 31*a*, and in order that the heat-source unit 1 itself is made operable, the process proceeds to step 104. In step 104, updating of the driving instruction information and the driving state information is performed, and the process then proceeds to step 105. Here, the driving instruction information and the driving state information of the heat-source unit controller 11 are set as driving.

In step 105, the valve of the refrigerant circuit and the like in the heat-source unit 1 are operated and the process then proceeds to step 106. In step 106, the compressor in the heat-source unit 1 is started, and the process then proceeds to step 107. In step 107, it is determined whether or not change from driving to stopped state is performed, when the change is to be performed, the process proceeds to step 108, and when not, the process proceeds to step 112. In this case, since the change is not to be performed, the process proceeds to step 112. In step 112, regular processes such as acquisition of sensor input and actuator control are performed, and the process then proceeds to step 113. In step 113, a process for newly transmitting a communication is performed.

(2) Communication when Compressor is Stopped

Next, a description will be given of content of communication when a compressor of a refrigeration air-conditioning apparatus is stopped. A description will be given of communication in a case of stopping the driving from a state in which only the indoor unit 2*a* among the indoor units is operating, by an operation of the remote controller 22*a*. First, the operator operates the remote controller 22*a* and performs an operation for stopping driving. The remote controller 22*a* transmits stop information to the indoor unit controller 21*a* through the transmission line 9*a*, and changes the display to show stopped state.

In step 161, the indoor unit controller 21*a* performs a process for analyzing the newly received communication. After the analysis process is performed, in step 162, the driving capability/incapability of the indoor unit 2*a* is determined, and the process then proceeds to step 163.

In step 163, it is determined whether or not a change from stopped state to driving is to be performed, when the change is to be performed, the process proceeds to step 164, and when not, the process proceeds to step 166. In this case, the process proceeds to step 166. In step 166, it is determined whether or not a change from driving to stopped state is to be performed, when the change is to be performed, the process proceeds to step 167, and when not, the process proceeds to step 171. In this case, the process proceeds to step 167.

In step 167, updating of the driving instruction information is performed, and the process then proceeds to step 168. Here, the driving instruction state of the indoor unit controller 21*a* is set as stopped state. In step 168, it is determined whether or not the driving state of the second relay controller 31*b* is stopped state, when the driving state is stopped state, the process proceeds to step 169, and when not, the process proceeds to step 171. In this case, since the driving state is not stopped state, the process proceeds to step 171. In step 171, regular processes such as acquisition of sensor input and actuator control are performed, and the process then proceeds to step 172. In step 172, a process for newly transmitting a communication is performed. Here, since the driving instruction information of the indoor unit 2*a* has been changed from driving to stopped state, the driving information is transmitted to the second relay controller 31*b* through the transmission line 10.

The driving state information is kept as driving while the driving instruction information is stopped state, thus the indoor unit controller 21*a* repeats this process until the driving state of the second relay controller 31*b* becomes stopped state while keeping in the state of changing from driving to stopped state.

Next, a description will be given of the operation of the second relay controller 31*b*. The second relay controller 31*b* performs a process for analyzing the newly received communication. After the analysis process is performed, in step 142, the driving capability/incapability of the second relay unit 3*b* is determined, and the process then proceeds to step 143. In step 143, it is determined whether or not a change from stopped state to driving is performed, when the change is to be performed, the process proceeds to step 144, and when not, the process proceeds to step 147. In this case, the process proceeds to step 147.

In step 147, it is determined whether or not a change from driving to stopped state is to be performed, when the change is to be performed, the process proceeds to step 148, and when not, the process proceeds to step 153. In this case, the process proceeds to step 148. At this time, if another indoor unit (2*b* in this example) is operating, since the driving information of the second relay controller 3*b* is not stopped state even if the indoor unit 2*a* is stopped, the change from driving to stopped state is not performed.

In step 148, updating of the driving instruction information is performed, and the process then proceeds to step 149. Here, the driving instruction information of the second relay controller 31*b* is set as stopped state. In step 149, it is determined whether or not the driving state of the first relay controller 31*a* is stopped state, in the case of the stopped state, the process proceeds to step 150, and in the case of not stopped state, the process proceeds to step 153. In this case, since the driving state is not stopped state, the process proceeds to step 153. Regular processes such as acquisition of sensor input and actuator control are performed, and the process then proceeds to step 154. In step 154, a process for newly transmitting a communication is performed. Here, since the driving instruction information of the second relay unit 3*b* has been changed from driving to stopped state, the driving information is transmitted to the first relay controller 31*a* through the transmission line 8. The driving state information is kept as driving while the driving instruction information is stopped state, thus the second relay controller 31*b* repeats this process until the driving state of the first relay controller 31*a* becomes stopped state while keeping in the state of changing from driving to stopped state.

Next, a description will be given of the operation of the first relay controller 31*a*. In step 121, the first relay controller 31*a* performs a process for analyzing the newly received communication. After the analysis process is performed, in step 122, the driving capability/incapability of the first relay unit 3*a* is determined, and the process then proceeds to step 123. In step 123, it is determined whether or not a change from stopped state to driving is performed, when the change is to be performed, the process proceeds to step 124, and when not, the process proceeds to step 126. In this case, the process proceeds to step 126.

In step 126, it is determined whether or not a change from driving to stopped state is performed, when the change is to be performed, the process proceeds to step 127, and when not, the process proceeds to step 131. In this case, the process proceeds to step 127. At this time, if another second relay controller (31*c* in this example) is operating, the driving information of the first relay controller 31*a* does not become stopped state while the second relay controller 31*b* is stopped, thus a change from driving to stopped state is not performed.

In step 127, updating of the driving instruction information is performed, and the process then proceeds to step 128. Here, the driving instruction information of the first relay controller 31*a* is set as stopped state. In step 128, it is determined whether or not the driving state of the heat-source unit controller 11 is stopped state, in the case of stopped state, the process proceeds to step 129, and when not, the process proceeds to step 131. In this case, since the driving state is not stopped state, the process proceeds to step 131. In step 131, regular processes such as acquisition of sensor input and actuator control are performed, and the process then proceeds to step 132. In step 132, a process for newly transmitting a communication is performed. Here, since the driving instruction information of the first relay unit 3*a* has been changed from driving to stopped state, the driving information is transmitted to the heat-source unit controller 11 through the transmission line 7. Since the driving state information is maintained to be driving though the driving instruction information is stopped state, the first relay controller 31*a* repeats this process until the driving state of the heat-source unit controller 11 becomes stopped state while keeping in the state of changing from driving to stopped state.

Next, a description will be given of the operation of the heat source controller 11. In step 101, the heat source controller 11 performs a process for analyzing the newly received communication. After the analysis process is performed, in step 102, the driving capability/incapability of the heat-source unit 1 is determined, and the process then proceeds to step 103. In step 103, it is determined whether or not a change from stopped state to driving is performed, when the change is to be performed, the process proceeds to step 104, and when not, the process proceeds to step 107. In this case, the process proceeds to step 107.

In step 107, it is determined whether or not a change from driving to stopped state is to be performed, when the change is to be performed, the process proceeds to step 108, and when not, the process proceeds to step 112. In this case, the process proceeds to step 108. In step 108, updating of the driving instruction information is performed, and the process then proceeds to step 109. Here, the driving instruction information of the heat-source unit controller 11 is set as stopped state. In step 109, the compressor in the heat-source unit 1 is stopped, and the process then proceeds to step 110. In step 110, the valve and the like of the refrigerant circuit in the heat-source unit 1 are operated, and the process then proceeds to step 111. In step 111, updating of the driving state information is performed, and the process then proceeds to step 112. Here, the driving state information of the heat-source unit controller 11 is set as stopped state. In step 112, regular processes such as acquisition of sensor input and actuator control are performed, and the process then proceeds to step 113. In step 113, a process for newly transmitting a communication is performed. Here, since the driving instruction information and the driving state information of the heat-source unit 1 have changed from driving to stopped state, the driving information is transmitted to the first relay controller 31*a* through the transmission line 7.

As a result of receiving this communication (transmission) by the first relay controller 31*a*, the first relay controller 31*a* determines, in step 128, that the heat-source unit controller 11 has stopped, and the process then proceeds to step 129. In step 129, the valve of the refrigerant circuit and the like in the first relay unit 3*a* are operated, and the process then proceeds to step 130. In step 130, the driving state information is updated, and the process then proceeds to step 131. Here, the driving state information of the first relay controller 31*a* is set as stopped state. After that, in step 132, the driving state information of the first relay controller 31*a* is transmitted to the second relay controller 31*b*.

As a result of receiving this communication (transmission) by the second relay controller 31*b*, the second relay controller 31*b* determines in step 149 that the first relay controller 31*a* is stopped, and the process then proceeds to step 150. In step 150, the valve of the refrigerant circuit and the like in the second relay unit 3*b* are operated, and the process then proceeds to step 151. In step 151, a pump of the water circuit in the second relay unit 3*b* is stopped, the valve of the water circuit and the like are operated, and the process then proceeds to step 152. In step 152, updating of the driving state information is performed, and the process then proceeds to step 153. Here, the driving state information of the second relay controller 31*b* is set as stopped state. After that, in step 154, the driving state information of the second relay controller 31*b* is transmitted to the indoor unit controller 21*a*.

As a result of receiving this communication (transmission) by the indoor unit controller 21*a*, the indoor unit controller 21*a* determines, in step 168, that the second relay controller 31*b* is stopped, and the process then proceeds to step 169. In step 169, the valve of the water circuit and the like in the indoor unit 21*a* are operated, and the process then proceeds to step 170. In step 170, updating of the driving state information is performed, and the process then proceeds to step 171. Here, the driving state information of the indoor unit controller 21*a* is set as stopped state. After that, in step 172, the driving state information of the indoor unit controller 21*a* is transmitted to the remote controller 22*a*.

In a case where the pump is not operating during the start of the compressor, since water is not flowing, the water temperature is suddenly changed, the high pressure of the compressor suddenly increases or the low pressure suddenly decreases in response to the rapid change, which might lead to an abnormal stop. However, in the information transfer method of the refrigeration air-conditioning apparatus of the present invention, even in a case where a failure of communication due to temporary noise or traffic increase occurs, the pump always has operated before the compressor starts, making it possible to always stop the pump after the compressor is stopped. For this reason, it is possible to ensure the stability of information transfer, and an interlock equipped by hardware can be eliminated. Furthermore, by performing communication between pairs of units by using different media/means (including hardware and software), it is possible to increase the degree of freedom in structuring the product. In addition, by using the optimal medium/means for each pair, it is possible to realize an improvement in quality and reduction in cost, to improve the degree of freedom of address allocation and to reduce communication traffic.

Embodiment 2

Figure 4:
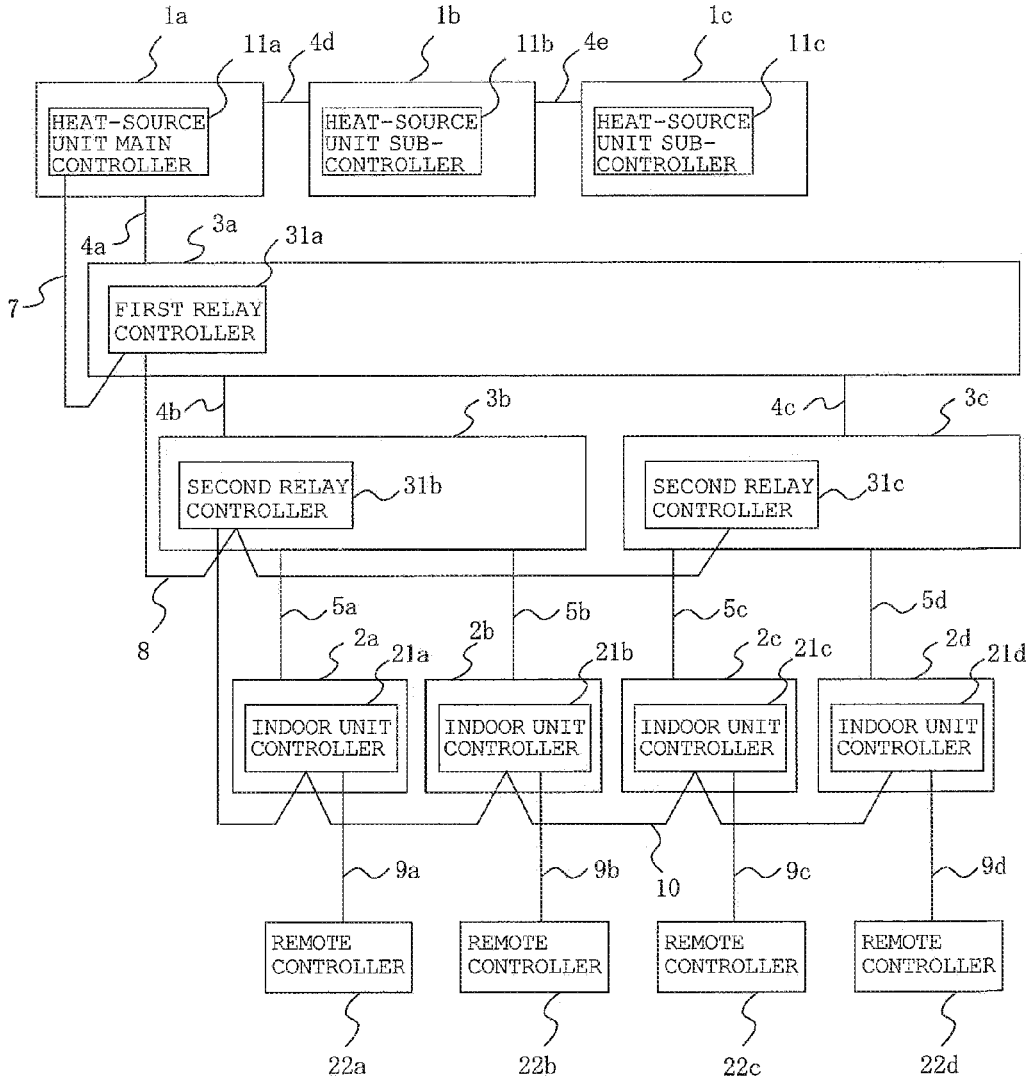
FIG. 4 is a schematic diagram illustrating an information transfer system for a refrigeration air-conditioning apparatus in Embodiment 2.

FIG. 4 illustrates the configuration of an information transfer device for a refrigeration air-conditioning apparatus in Embodiment 2 of the present invention. The refrigeration air-conditioning apparatus shown in FIG. 4 forms one refrigerant circuit system, in which a heat source main unit (outdoor main unit) 1*a*, heat source subunits (outdoor subunits) 1*b* and 1*c*, a first relay unit 3*a*, and second relay units 3*b* and 3*c* are connected by refrigerant piping 4*a*, 4*b*, 4*c*, 4*d*, and 4*e*. The refrigeration air-conditioning apparatus may be formed so as to have no heat-source subunit.

Furthermore, the second relay unit 3*b* and a plurality of indoor units (use-side units) 2*a* and 2*b* are connected by water piping 5*a* and 5*b*, forming one water circuit system, and the second relay unit 3*c* and the plurality of indoor units (use-side units) 2*c* and 2*d* are connected by water piping 5*c* and 5*d*, forming one water circuit system.

The heat-source units 1*a*, 1*b*, and 1*c* each include a compressor, a valve circuit such as a four-way valve, an outdoor-side heat exchanger and the like, and supplies heat necessary for a system over a refrigerant.

The first relay unit 3*a* includes a gas liquid separator, a valve circuit, and the like, divides the transported refrigerant into three; high-pressure gas, middle-pressure liquid and low pressure gas, and supplies them as cooling or heating heat sources.

The second relay units 3*b* and 3*c* each include a refrigerant-water heat exchanger, a directional control valve, a water pump and the like, transfer necessary heat to the water from the cooling refrigerant and the heating refrigerant, and circulate the water storing a quantity of heat necessary for the water circuit.

The indoor units 2*a* to 2*d* each include an indoor-side heat exchanger, and perform heat exchange transfer of the quantity of heat from the circulated water to the indoor air.

The heat-source units 1*a*, 1*b*, and 1*c* are controlled by the heat-source unit controllers 11*a*, 11*b*, and 11*c*, respectively, and the first relay unit 3*a* is controlled by the first relay controller 31*a*. The second relay units 3*b* and 3*c* are controlled by the second relay controllers 31*b* and 31*c*, respectively. The indoor units 2*a* to 2*d* are controlled by the indoor unit controllers 21*a* to 21*d*, respectively. The heat-source unit controllers 11*a*, 11*b*, and 11*c* and the first relay controller 31*a* are directly connected to one another through the transmission line 7 so as to transfer information. The first relay controller 31*a* and the second relay controllers 31*b* and 31*c* are directly connected to one another through the transmission line 8 so as to transfer information. The second relay controllers 31*b* and 31*c* and the indoor unit controllers 21*a* to 21*d* are directly connected to one another through the transmission line 10 so as to transfer information. Furthermore, the indoor unit controllers 21*a* to 21*d* are connected to the remote controllers 22*a* to 22*d*, respectively, through the transmission lines 9*a* to 9*d*, respectively, so as to transfer information.

Figure 5:
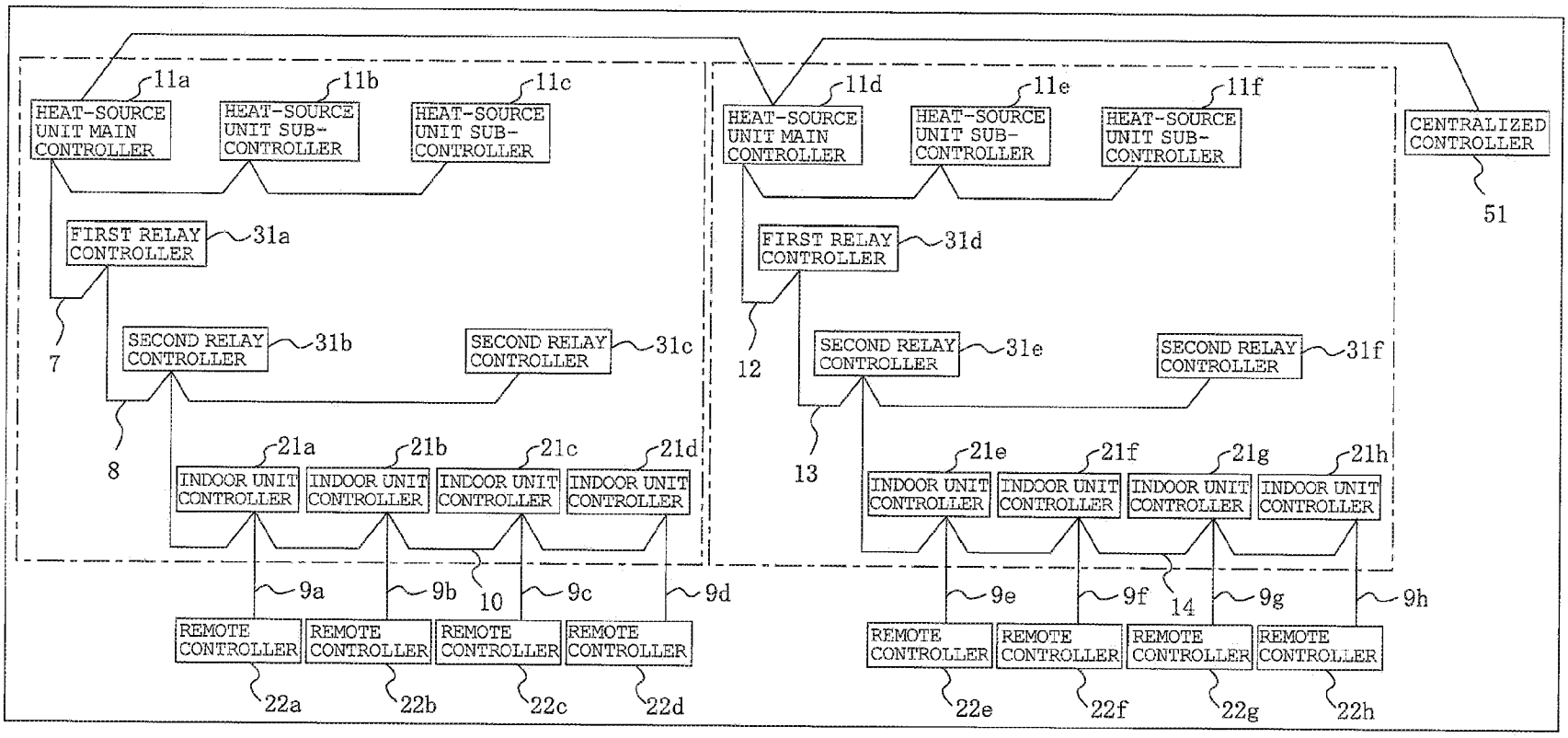
FIG. 5 is a schematic diagram illustrating another example of the information transfer system of Embodiment 2.

FIG. 5 illustrates an information transfer system (communication system) in a case where plural systems for the refrigeration air-conditioning apparatus shown in FIG. 4 are included. A heat-source unit main controller 11*a* of a certain refrigerant system is connected to a heat-source unit main controller lid of another refrigerant system through a transmission line 15, and furthermore, a centralized controller 51 for performing centralized management of a refrigeration air-conditioning apparatus is connected to the transmission line 15.

Each of the refrigerant systems (units that are connected by refrigerant piping and water piping) are shown using a short-dashed-line frame.

In a refrigeration air-conditioning apparatus of the related art, generally the transmission lines 7, 8, 10, 12, 13, and 14 are configured using the same means/medium, and furthermore, there is a case in which the transmission lines 9*a* to 9*h* are connected by the same means/medium as the above.

The advantages of the configuration in which the same means/medium is used for all the transmission lines as described above are that it is sufficient that each controller incorporates only one transmission and reception circuit, and wiring work is easy. However, in recent years, with larger-scale systems and sophistication of functions, problems of an increase in communication traffic and occupation of address space have arisen in such a system. Regarding communication traffic, since many controllers are present on the same bus, communication traffic increases in proportional to the number of controllers. Furthermore, in order to perform communication over the same bus, it is necessary for each controller to have a different address. For example, in the case of the system of FIG. 5, 29 addresses are necessary, but in an actual refrigeration air-conditioning apparatus, generally, the number of indoor units of one refrigerant system is much greater. For this reason, actual management targets for which driving/stopping, a change of setting and the like are performed in the centralized controller are indoor units, and since there are large numbers of heat-source units and relay units, the address space is occupied and a problem arises in that the number of connected units is limited.

In a transmission method in which the same means/medium is used for all the transmission lines, although all the controllers can communicate with one another, it is possible to receive different instructions from a plurality of different controllers, and thus, it is necessary to construct a communication protocol for preventing collision of control and occurrence of mismatches.

Figure 6:
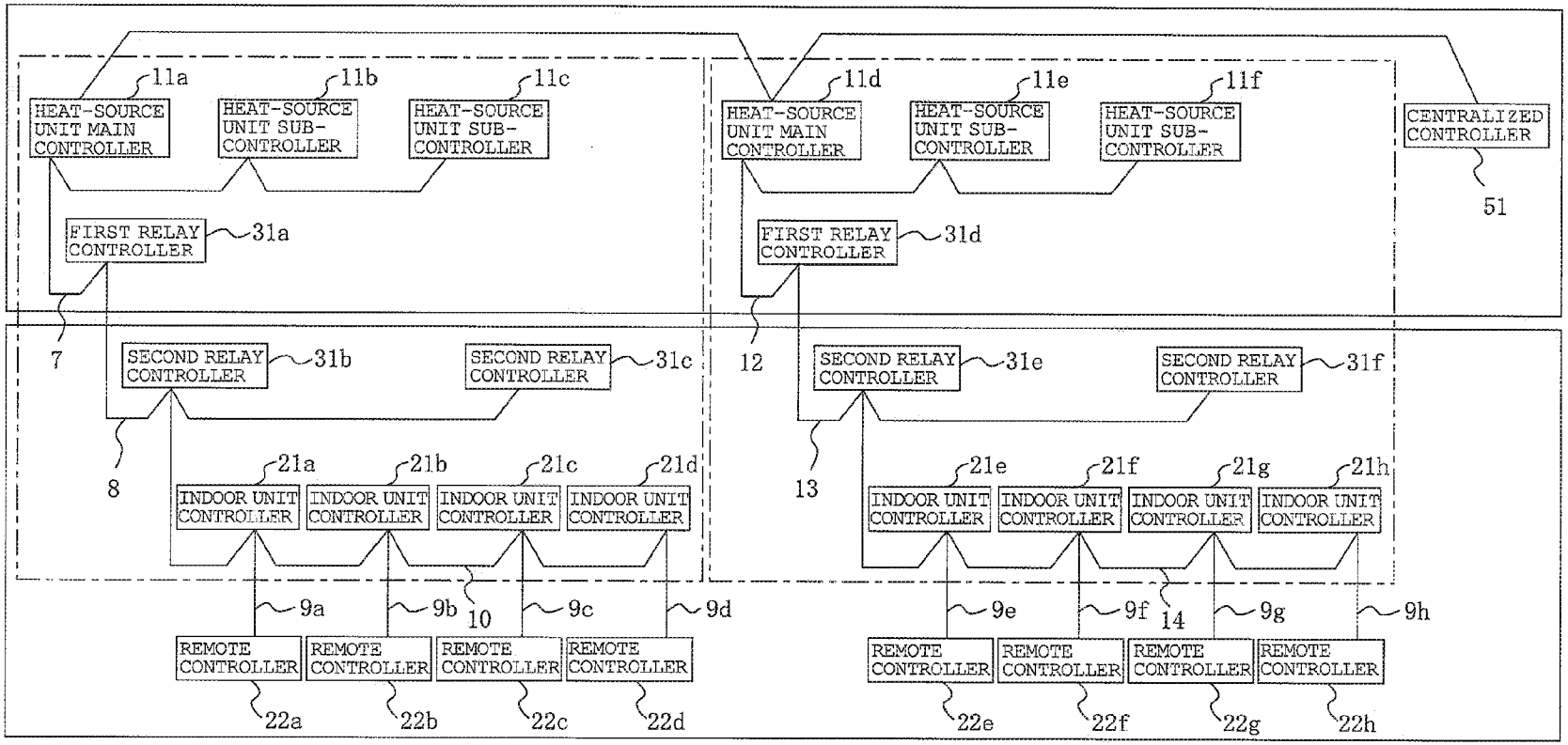
FIG. 6 is a schematic diagram illustrating another example of the information transfer system of Embodiment 2.

FIG. 6 illustrates an information transfer system (communication system) in a case where, similarly to FIG. 5, plural refrigeration air-conditioning apparatuses shown in FIG. 4 are included, and here, illustrates an example of a case in which the transmission lines 8 and 13 are configured using means/media (including software and hardware) differing from the other transmission lines. When configured as described above, it is possible to separate the communication bus on the heat-source unit side from the communication bus on the indoor unit side. As a result, it is possible to reduce the communication traffic of each communication bus. Furthermore, in this example, the number of occupied address spaces on the heat-source unit side is 9 and the number thereof on the indoor unit side is 20. Here, even if the same address setting is performed on the heat-source unit side and the indoor unit side, since communication is performed with the first relay controller 31*a* on the heat-source unit side, and communication is performed with the second relay controllers 31*b* and 31*c* on the indoor unit side, it is possible for the system to make identification without problems. Therefore, this becomes equivalent to increase addresses that can be set, it is possible to deal with an increase in the number of controllers, and the degree of freedom of address allocation can be increased. Furthermore, as a result of separating the communication bus, there is an advantage that a control algorithm and a communication protocol can be simplified by limiting the number of communication-capable controllers.

In FIG. 6, although the transmission line 15 to which a plurality of refrigerant systems are connected is arranged in the heat-source unit main controllers 11*a* and lid, and the centralized controller 51 is connected to the transmission line 15, a transmission line that connects a plurality of refrigerant systems to the first relay controllers 31*a* and 31*d*, the second relay controllers 31*b*, 31*c*, 31*e*, and 31*f*, or the indoor unit controllers 21*a* to 21*h* and a centralized controller may be connected. In a case to connect to the indoor unit controller, since it is not necessary to connect a transmission line to an outdoor heat-source unit, there is an advantageous effect that the length of a transmission line that connects a plurality of refrigerant systems is shortened. Furthermore, in a case to connect to the first relay controller or the second relay controller, there is the same advantageous effect, and at the same time, by making connection to a transmission line of means/medium different from that of the indoor unit and the heat-source unit, the degree of freedom of address allocation is further improved, thus, there is an advantageous effect that communication traffic can be reduced.

Regarding FIG. 6, it is described that a communication medium that is different from a rest pair is used for between the pair of the first relay controller and the second relay controller. However, in a case where the second relay controller communicates with the first relay controller and communicates with the indoor unit controller by adopting different communication means and medium (including software and hardware), it is possible to separate into two different transmission media; among the heat-source unit controller, the first relay controller, and the second relay controller and between the second relay controller and the indoor unit controller. This is a so-called gateway method, and if only the second relay controller performs the replacement of transmission, the system can be separated into two even if the above-mentioned two transmission media use the physically same method, and thus, the configuration is simple.

Furthermore, since the system is constructed in such a way that, as described above, each controller has a unique address and communicates with other apparatuses by using dedicated communication means, the controller is a dedicated product, but only the controller is made to be a dedicated product for each subsystem, and general-purpose products can be adopted for the components. In particular, since the indoor unit is an air-water heat exchanger, and basically, is a combination of a heat exchanger and a fan, constrains in design are small, and it is effective that the controller unit and the structural unit are made separable.

INDUSTRIAL APPLICABILITY

The information transfer system described in each of the above-described embodiments can be used for a cooling apparatus and an air-conditioning apparatus that includes a refrigerant circuit on a heat-source side and a water circuit for performing heat exchange with a refrigerant circuit on a use side.

The invention claimed is:

1. An information transfer system for a refrigeration air-conditioning apparatus, comprising at least one heat-source unit that includes a heat-source unit controller;

an outdoor-side heat exchanger, one first relay unit including a first relay controller and a gas-liquid separator through which a refrigerant passes from said heat-source unit, and at least one second relay unit including a second relay controller and a refrigerant-water heat exchanger through which the refrigerant passes from said first relay unit, which are connected by refrigerant piping, and at least one indoor unit, including an indoor-side heat exchanger and an indoor unit controller, connected to said second relay unit by water piping, wherein said indoor unit performs heat exchange between water, to which heat exchange is performed by said refrigerant-water heat exchanger, and an indoor air by said indoor-side heat exchanger, wherein communications are performed discretely between a pair comprising said heat-source unit controller and said first relay controller over a first signal transmission line, a pair comprising said first relay controller and said second relay controller over a second signal transmission line, and a pair comprising said second relay controller and said indoor unit controller over a third signal transmission line.

2. The information transfer system for the refrigeration air-conditioning apparatus of claim 1, wherein an operation sequence for pairs of units is defined with a communication protocol at the time of start/stop of the refrigeration air-conditioning apparatus.

3. The information transfer system for the refrigeration air-conditioning apparatus of claim 2, wherein when the refrigeration air-conditioning apparatus is to be started, a start operation is performed in a sequence of said indoor unit, said second relay unit, said first relay unit, and said heat-source unit, and when the refrigeration air-conditioning apparatus is to be stopped, a stop operation is performed in a sequence of the heat-source unit, said first relay unit, said second relay unit, and said indoor unit.

4. An information transfer system including a plurality of refrigeration air-conditioning apparatuses described in claim 1, comprising:

a centralized controller for performing centralized management connecting to each refrigeration air-conditioning apparatus through a controller of corresponding heat-source unit, a controller of corresponding first relay unit, a controller of corresponding second relay unit, or a controller of corresponding indoor unit.

5. The information transfer system for the refrigeration air-conditioning apparatus of claim 1, wherein each unit has a corresponding controller that controls operations of the corresponding unit, and in between each pair of units that communicate with each other, a driving/stopping instruction information of a controller possessed by one unit is transferred to the other unit and a driving/stopping instruction information of a controller possessed by the other unit is transferred to the one unit.

* * * * *